US006594906B1

(12) United States Patent
Sakai et al.

(10) Patent No.: US 6,594,906 B1
(45) Date of Patent: Jul. 22, 2003

(54) KNIFE WITH INTEGRAL GATED ATTACHMENT

(75) Inventors: Kimiyuki Sakai, Seki (JP); Stephen J. Hull, San Diego, CA (US)

(73) Assignee: Buck Knives, Inc., El Cajon, CA (US)

( * ) Notice: Subject to any disclaimer, the term of this patent is extended or adjusted under 35 U.S.C. 154(b) by 0 days.

(21) Appl. No.: 09/758,915

(22) Filed: Jan. 10, 2001

(51) Int. Cl.[7] ..... B26B 3/06; B26B 11/00
(52) U.S. Cl. ..... 30/155; 30/298.4; 7/118
(58) Field of Search ..... 30/155, 298.4; 7/118–120; 24/234, 232 G, 253, 231

(56) References Cited

U.S. PATENT DOCUMENTS

| | | | | | |
|---|---|---|---|---|---|
| 244,498 | A | * | 7/1881 | Terpany | 30/155 |
| 272,570 | A | * | 3/1883 | Davis | 30/155 |
| D75,785 | S | * | 5/1928 | Peters | 30/155 |
| 1,828,121 | A | * | 10/1931 | Adam et al. | 30/156 |
| 4,095,316 | A | * | 6/1978 | Gabriel | 24/599.1 |
| 4,333,212 | A | * | 6/1982 | Bibollet | 24/599.6 |
| 4,563,813 | A | * | 1/1986 | Fortenberry | 7/118 |
| 4,776,094 | A | * | 10/1988 | Glesser | 30/160 |
| 4,802,279 | A | * | 2/1989 | Rowe | 30/155 |
| 5,270,909 | A | * | 12/1993 | Weiss et al. | 16/110.1 |
| 5,283,920 | A | * | 2/1994 | Plummer | 43/4 |
| 5,329,675 | A | | 7/1994 | McLean et al. | |
| 5,400,451 | A | * | 3/1995 | Furukawa | 7/118 |
| 5,463,798 | A | * | 11/1995 | Wurzer | 24/599.5 |
| 5,495,673 | A | * | 3/1996 | Gardiner et al. | 30/155 |
| 5,553,340 | A | * | 9/1996 | Brown, Jr. | 7/118 |
| 5,572,793 | A | * | 11/1996 | Collins et al. | 30/155 |
| 5,628,117 | A | * | 5/1997 | Glesser | 30/155 |
| 5,704,129 | A | * | 1/1998 | Glesser | 30/155 |
| 5,727,319 | A | * | 3/1998 | Myerchin et al. | 30/123 |
| 5,822,867 | A | * | 10/1998 | Sakai | 30/155 |
| 5,878,834 | A | | 3/1999 | Brainerd et al. | |
| 5,953,821 | A | * | 9/1999 | Mearns | 30/155 |
| 5,983,686 | A | * | 11/1999 | Lee | 224/269 |
| 6,113,617 | A | * | 9/2000 | van der Merwe | 30/155 |
| 6,223,372 | B1 | | 5/2001 | Barber | |
| 6,402,763 | B1 | * | 6/2002 | Scott | 30/155 |

* cited by examiner

*Primary Examiner*—Allan N. Shoap
*Assistant Examiner*—Jason Prone
(74) *Attorney, Agent, or Firm*—Gregory Garmong

(57) ABSTRACT

A knife has an implement lying in an implement plane and an attachment structure lying in the implement plane. The attachment structure is integral with the knife body with a fixed portion extending laterally from the top of the knife body. A gate is pivotably attached to a first part of the fixed portion of the attachment structure and pivotable in the implement plane between a closed position and an open position. When the gate is opened, the attachment may be clipped to another article, and the knife is releasably attached to the other article when the gate is closed.

15 Claims, 4 Drawing Sheets

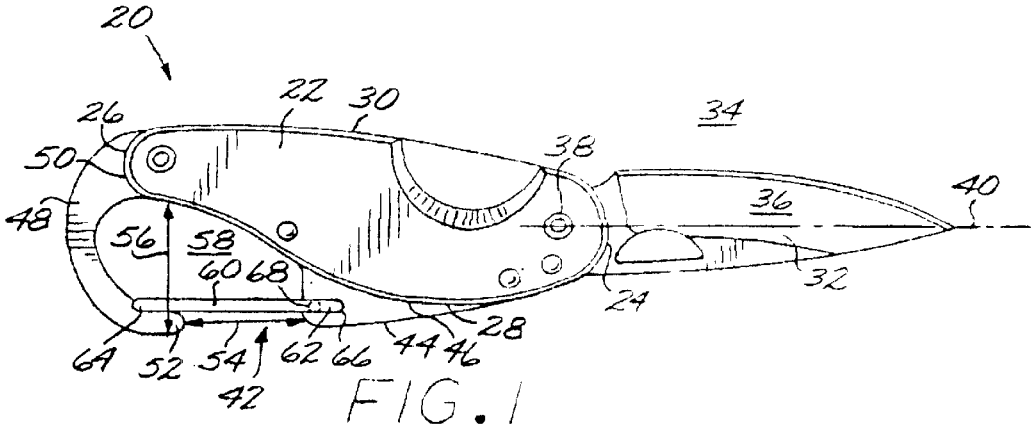
FIG. 1
FIG. 2
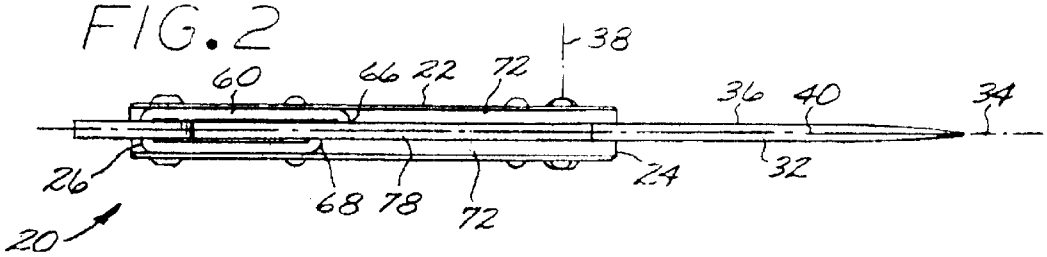
FIG. 3
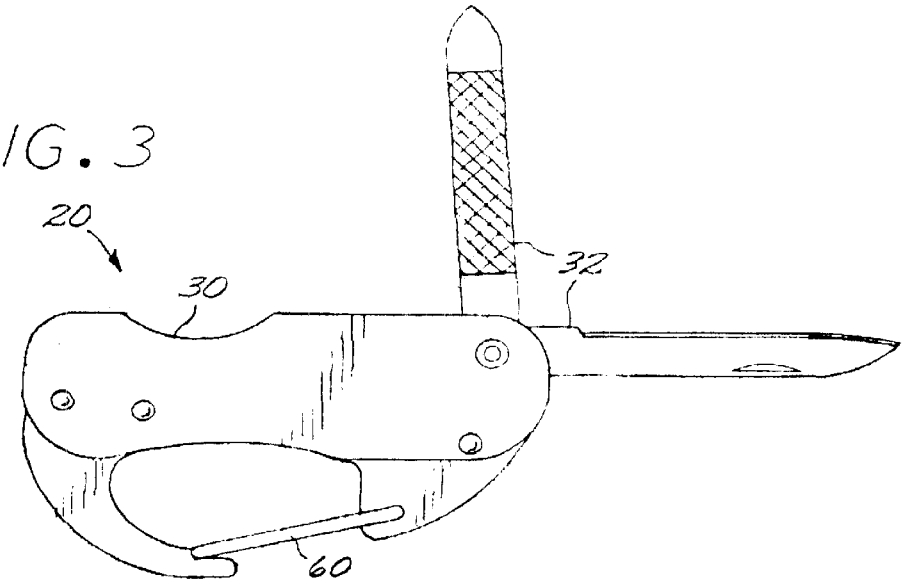

KNIFE WITH INTEGRAL GATED ATTACHMENT

This invention relates to a knife, and more particularly to a knife having an integral gated attachment.

BACKGROUND OF THE INVENTION

Many knives are intended to be conveniently carried on the person of the user of the knife, and a number of carrying approaches have been devised. For example, smaller knives with folding implements, termed pocket knives, are carried in the pocket of the user. Fixed-implement knives such as conventional hunting knives and some types of folding-implement knives are provided with a sheath or pouch that is carried on the belt of the user. The knife itself is held in the sheath or pouch either by friction or with a strap. The knife is removed from the sheath or pouch when the knife is to be used.

In some situations, it is desirable that the knife be carried externally to the clothing of the user for quick access. A belt clip on the body of the knife allows the knife to be clipped to the belt of the user. A lanyard strung through a hole in the knife body permits the knife to be carried around the neck of the user or otherwise releasably attached to the body or equipment of the user. A nonintegral clip through a hole in the knife body can be used to attach the knife to other objects, as for example with a small knife attached by a clip to a keychain.

Each of the available approaches has limitations and shortcomings in specific situations. Carrying a knife in a pocket limits the size of the knife and also may make it difficult to extract the knife from the clothing. A sheath or pouch adds weight and may be awkward to use. The belt clip is limited as to the nature of the structure to which it is clipped. A knife carried on a lanyard or nonintegral clip can swing wildly, and the lanyard may become tangled.

There is a need for an attachment approach which is compact and allows the knife to be releasably attached to other articles. The present invention fulfills this need, and further provides related advantages.

SUMMARY OF THE INVENTION

The present invention provides a knife with an attachment structure that is particularly convenient for attaching the knife to a wide variety of other articles to which attachment is otherwise difficult. The ability to attach the knife to large or bulky articles is particularly facilitated. The attachment structure is smoothly integral with the knife body, so that it does not risk entanglement with clothing or other structure and is not unsightly. The invention also provides a knife construction that structurally integrates the attachment structure into the body of the knife for strength, for improved manufacturability, and for reduced cost.

In accordance with the invention, a knife comprises a knife body having a first body end, a second body end, a top, and a bottom, and at least one implement (e.g., a cutting blade, file, scissors, or other implement) extending from the knife body at the first body end and lying in an implement plane. The implement may be fixedly or pivotably joined to the knife body at the first body end. An attachment structure comprises a gate attachment integral with the knife body at a first location, and an attachment arm integral with the knife body at a second location, which may be at or near the second body end of the knife. The attachment arm has an attachment-arm end separated from the gate attachment. Stated alternatively, a fixed attachment extends laterally from the top of the knife body in the implement plane. At least one of the gate attachment and the attachment-arm end is positioned laterally from the knife body so that there is an attachment separation therebetween. A gate has a first gate end and a second gate end, and the first gate end is pivotably joined to the gate attachment, preferably by a gate-pivot pin. The gate is pivotable in the implement plane between a closed position wherein the second gate end lies adjacent to the attachment-arm end and an open position wherein the second gate end is separated from the attachment-arm end to form an opening between the gate attachment and the attachment-arm end. The gate is biased toward the closed position.

In one embodiment, the gate attachment and/or the attachment arm are integral with the knife body along the knife body top. Desirably, the second gate end is closer to the knife body top when the gate is in the open position than when the gate is in the closed position. In this embodiment, the second gate end contacts the attachment-arm end when the gate is in the closed position.

The present invention provides a knife construction which is strong and adapted to the use of the described attachment structure. It includes in one construction embodiment an implement-support plate to which a base of the implement is pivotably attached at the first end of the knife body, and an attachment plate from which the gate attachment and the attachment arm extend. The implement-support plate and the attachment plate typically lie in a side-by-side relation. Preferably, two implement-support plates form the knife body. Optionally, separate side bolsters that form the external sides of the knife body may be provided in a side-by-side relation with the implement-support plate and the attachment plate. More preferably, however, there are two implement-support plates, and these two implement-support plates form the external sides of the knife body as well as support the implement(s).

Where the implement is pivotable, a spring arm may extend from the attachment plate and contact the base of the implement. Where the implement base has a cam surface thereon that is contacted by the spring arm, the implement movement may be given a detent action at the closed and/or open positions.

The attachment structure is particularly well suited for quick, reliable external attachment to and detachment from bulky objects. Attachment and detachment are readily accomplished with one hand in most cases. Such bulky objects include, for example, a ring attachment of the handle of a purse or brief case, a D-ring or ring, a rope, and the like. Conventional spring attachments of the type found on writing pens and many knives cannot readily be used to attach the combination tool to such bulky objects.

In conventional knives with belt clips, the force required to open the clip increases with increasing size of the gap that is desired. The result is that attachment of the clip to another article becomes increasingly difficult with increasing thickness of the other article. The clip attachment cannot easily attach to and detach from thick rings and other bulky articles because of the increasing force required to open the clip to the required size, and because the rings are too thick to pass easily through the resulting attachment gap in the clip structure easily. With the present approach, by contrast, the spring-loaded pivoting gate opens widely with only slightly increased biasing force to be overcome by the user, and then reliably closes to retain the attachment to the other article.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 1 is an elevational view of a knife according to the invention;

FIG. 2 is a bottom view of the knife of FIG. 1;

FIG. 3 is an elevational view of another embodiment of the knife;

FIGS. 11–13 are elevational views of a fixed-implement knife, wherein FIG. 11 shows the knife with an integral sheath in a position pivoted to overlie the knife body, FIG. 12 shows the knife with the integral sheath in an intermediate pivoted position, and FIG. 13 shows the knife with the integral sheath pivoted to overlie the implement.

DETAILED DESCRIPTION OF THE INVENTION

Figure 4:
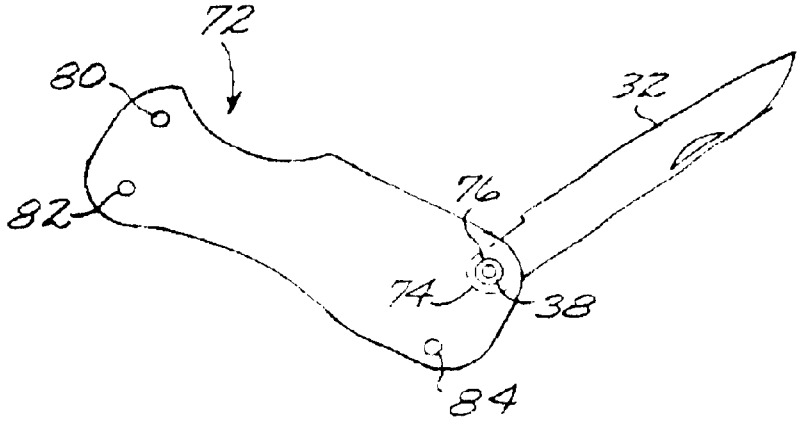
FIG. 4 is an elevational view of the implement-support plate and its relation to the implement.

FIGS. 1–2 depict a knife 20 having a knife body 22 with a first body end 24, a second body end 26, a top 28, and a bottom 30. At least one implement 32 is joined to and extends from the knife body 22 at the first body end 24. The implement 32 may be fixed or it may be movable. In the illustrated preferred embodiment of FIGS. 1–2, the knife 20 is a folding knife and the implement 32 is pivotable between the illustrated open-implement position and a closed-implement position in which the implement lies folded within the knife body 22.

The implement 32 lies in an implement plane 34. The implement plane 34 is defined by a face 36 of the implement 32, and it also is the plane in which the implement 32 moves as it is pivoted in the case of a pivoting implement. That is, the implement plane 34 is perpendicular to a pivot axis 38 of the implement. In FIG. 1, the implement plane 34 is the plane of the page, and in FIG. 2 the implement plane 34 is perpendicular to the page and coincident with an axis of elongation 40 of the implement 32.

An attachment structure 42 comprises a gate attachment 44 integral with the knife body 22 at a first location 46. The attachment structure 42 further comprises an attachment arm 48 integral with the knife body 22 at a second location 50. In the illustrated embodiment, the first location 46 is at the top 28 of the knife body 22 and intermediate between the first body end 24 and the second body end 26. The second location 50 is at the second body end 26. The gate attachment 44 and the attachment arm 48 are fixed and do not move relative to the knife body 22. The gate attachment 44 and the attachment arm 48 lie in the implement plane 34.

The attachment arm 48 has an attachment-arm end 52 separated from the gate attachment 44 by a gap 54. The gate attachment 44 and/or the attachment-arm end 52 are positioned laterally from the knife body 22, so that there is an attachment separation 56 therebetween. The attachment separation 56 ensures that the attachment structure 42 and the knife body 22 cooperatively define and encompass an open area 58. The provision of the attachment separation 56 and the open area 58 is facilitated by sculpting the top 28 of the knife body 22 so that the separation between the top 28 and the bottom 30 is relatively greater at the first location 46, and is relatively smaller at the second location 50.

A gate 60 has a first gate end 62 pivotably affixed to the gate attachment 44, and a second gate end 64 that lies adjacent to the attachment arm end 52 when the gate 60 is closed. The gate 60 may be of any operable type. A preferred gate 60 comprises a folded length of heavy gauge wire, with one end inserted into a first through hole 66 in the first gate attachment 44 and the other end inserted into an adjacent second through hole 68 in the first gate attachment (from the opposite side so as not to be visible in FIG. 1). The bending of the wire and the insertion of the ends into the holes 66 and 68 produces a biasing force that biases the gate 60 toward the closed position illustrated in FIG. 1. The gate 60 may instead be a solid piece of metal pivotably joined to the gate attachment 44 and biased toward the closed position with a leaf spring.

When the gate 60 is in the open position, the second gate end 64 is closer to the top 28 than when the gate 60 is in the closed position, so that the attachment structure 42 may be slipped over another article that passes through the space between the attachment-arm end 52 and the second gate end 64 and thereafter lies in the open area 58. The gate 60 is allowed to pivot back to the closed position, thereby capturing the other article in the open area 58 to attach the knife 20 to the other article. The knife 20 is removed from the other article by reversing these steps.

The attachment structure 42 may have various geometries. In the knife 20 of FIG. 1, the gate 60 lies substantially parallel to the knife bottom 30 when the gate 60 is in the closed position. In other geometries, such as the knife 20 of FIG. 3, the gate 60 is angularly offset from being parallel to the knife bottom 30 when the gate 60 is in the closed position.

The knife 20 may have one implement 32, as shown in FIGS. 1–2, or more than one implement 32, as shown in FIG. 3. The implement 32 may be a cutting blade or it may be another type of implement. Examples of other types of implements include a screwdriver, a wrench, an ice pick, a scissors, a pliers, a file, an awl, a compass, a mirror, a bottle opener, a can opener, a cork screw, a hoof pick, and a measuring device. The implements may be selected and grouped for specific applications of the knife. For example, a knife 20 specially adapted for use by fishermen may include a scissors, an awl, a knife, and a screwdriver. In another example, a knife 20 specially adapted for use by a backpacker may include a compass, a knife, a screwdriver, a can opener, and a bottle opener. More than one feature may be present on the same implement, as for example an implement that has a screwdriver at the end of the implement and a bottle opener at an intermediate location along the length of the implement.

Figure 5:
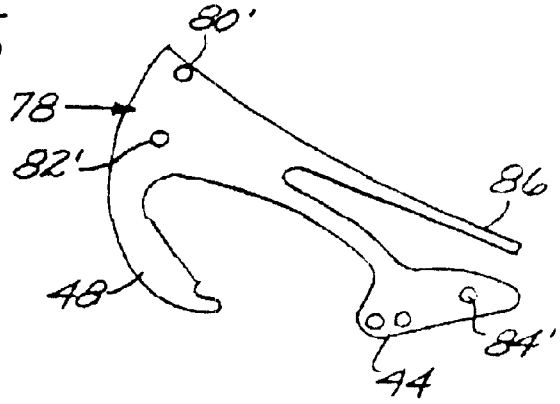
FIG. 5 is an elevational view of the attachment plate.

The attachment structure 42 is desirably constructed integral with the knife body 22, as distinct from being affixed to the completed knife body, for increased strength, ease of manufacturing, reduced cost, and integration of the components. FIGS. 2 and 4–5 illustrate the preferred integral construction.

An implement-support plate 72, illustrated in FIG. 4, bears the loading of the implement 32. In the preferred approach, there are two implement-support plates 72 that serve as the sides (also sometimes termed "bolsters") of the knife body 22. In this preferred approach, the two implement-support plates 72 are parallel and spaced apart by support posts in the form of rivets. In an alternative embodiment, there are separate side plates and the implement-support plate 72 is positioned between them, but that design adds unnecessary bulk and weight to the knife body.

The implement 32 has a base 74 that is pivotably attached to the implement-support plates 72 by an implement pivot pin 76 coincident with the pivot axis 38. The implement pivot pin 76 extends through aligned pivot holes in the implement-support plates 72 and the base 74 of the implement 32, so that the implement 32 is supported on the implement-support plates 72 to pivot in the implement plane 34. The implement 32 may pivot between an extended position and a closed position wherein the implement lies between the two implement-support plates 72.

An attachment plate 78, illustrated in FIG. 5, lies side-by side with, and between in the preferred embodiment, the implement-support plates 72. The gate attachment 44 and the attachment arm 48 are part of the attachment plate 78 and extend rigidly therefrom and laterally from the knife body 22 in the manner illustrated in FIG. 1. In the assembled knife 20, the implement-support plate 72 and the attachment plate 78 are aligned by respective pairs of locating holes 80 and 80', 82 and 82', and 84 and 84', through which rivets extend to attach the plates 72 and 78 together and hold the plates 72 and 78 in the required fixed orientation and spacing. The implement-support plates 72 and the attachment plate 78 are made of steel or aluminum alloy in the preferred embodiment.

Figure 6:
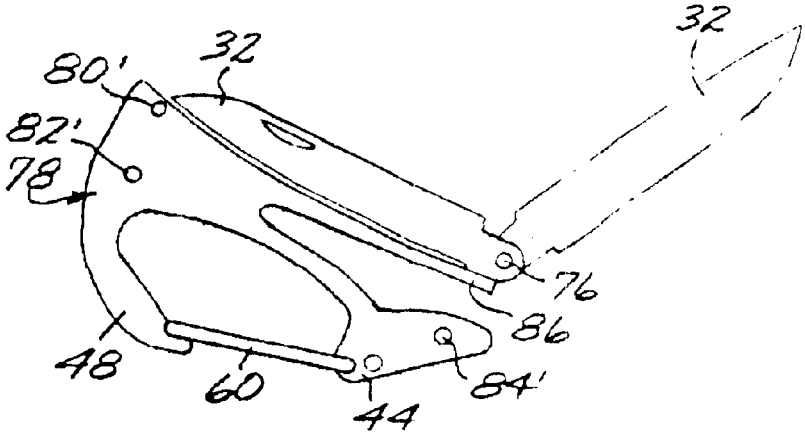
FIG. 6 is an elevational view of the attachment plate showing its relation to the pivoting of the implement blade.

A spring arm 86 extends from the attachment plate 78. FIG. 6 illustrates the relation of the implement 32 to the attachment plate 78 and the spring arm 86. The implement 32 lies in the same plane as the attachment plate 78. In FIG. 6, the implement is shown in a closed (folded) position and in a partially open position, but in each case with its implement pivot pin 76 in the proper relation to the attachment plate 78 and the spring arm 86, as though the implement-support plate 72 were present and not omitted for clarity. With the implement-support plate 72 and the attachment plate 78 aligned as described above, the spring arm 86 is biased toward the implement base so that it contacts and bears against the narrow surface of the implement base 74 of the implement 32. The spring arm 86 rides on the implement base 74 as the implement 32 pivots on the implement pivot pin 76. Preferably, the implement base 74 is contoured with a cam surface thereon as illustrated, so that the spring arm 86 serves as a cam follower. The camming action serves to bias the implement 32 toward the positions associated with, the local low points in the cam surface, which may be positioned as illustrated so that the implement 32 is biased toward the fully implement-open position (not illustrated) and the fully implement-closed position (illustrated), when the implement is rotated so as to be close to these two end-point positions. The biasing of an implement 32 toward the end-point positions using a cam-follower approach is known in the art using other structures, but the present approach of making the cam-follower spring arm 86 with an attachment plate 78 is not known. The present approach allows the attachment structure and the cam follower spring arm 86 to be made with a single part, the attachment plate 78, reducing part counts and both manufacturing complexity and cost. The strength of the knife is improved and its manufacturing costs are reduced even further by making the gate attachment 44 and the attachment arm 48 integral with the attachment plate 78, as shown.

Figure 7:
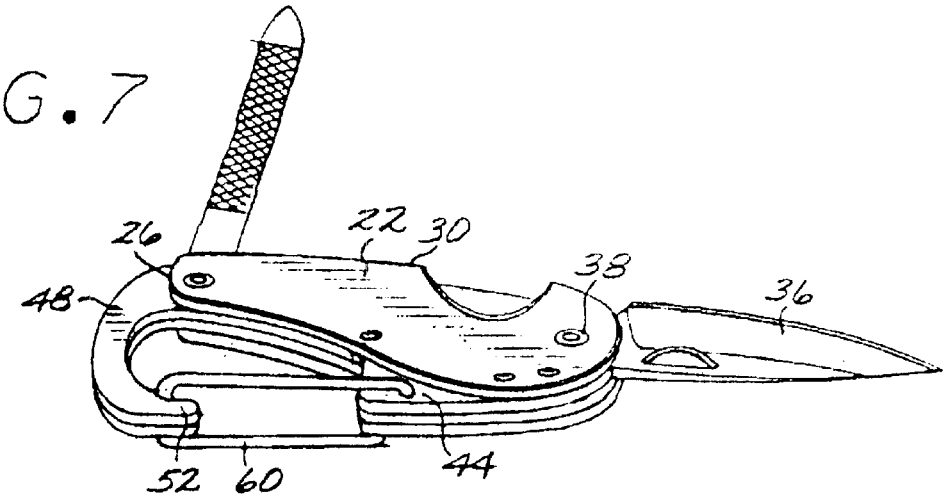
FIG. 7 is a perspective view of an embodiment of the knife having blades opening from both ends.
Figure 8:
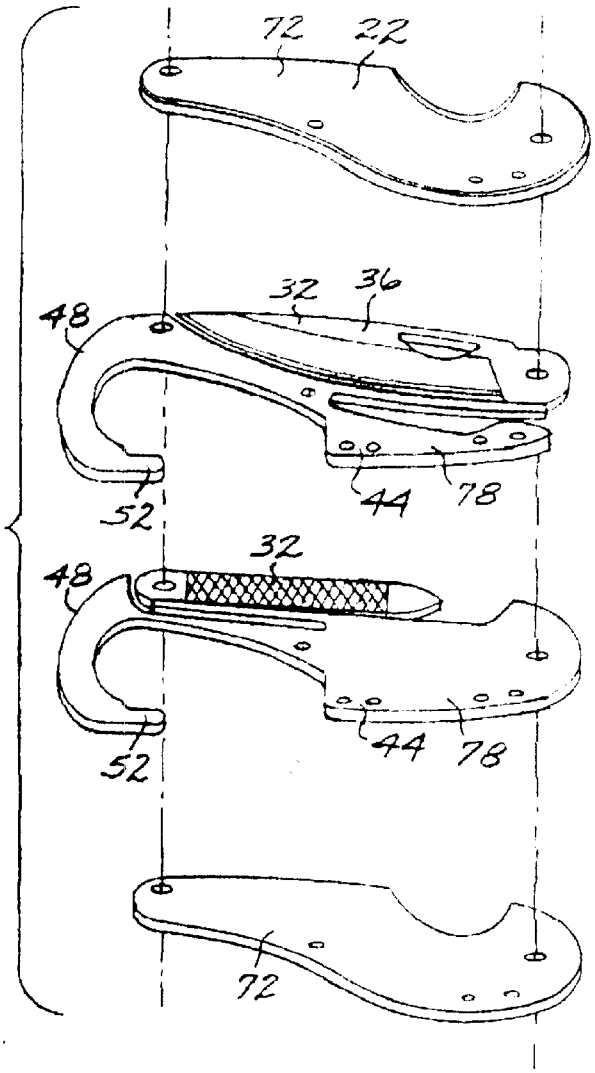
FIG. 8 is an exploded perspective view of the knife of FIG. 7.

The structural approach shown in FIGS. 4–6 may be extended to multiple implements opening from the same end of the knife body, as in FIG. 3, or to multiple implements opening from opposite ends of the knife body as in FIGS. 7–8. When the knife has multiple implements, there may be a single attachment plate 78 that provides the biasing for all of the implements at once. This approach is not preferred, because the opening of one implement temporarily removes the biasing force from the other implements as the spring arm is depressed, causing the other implements to be unbiased and tending to rattle. More preferably, as shown in FIG. 8, a stacked design is used wherein the blade-support plates 72 form the sides of the knife body, and then there is one attachment plate 78 for each of the implements 32. The structure of FIG. 8 provides two attachment plates 78 with two respective implements 32. The attachment plates are generally like those discussed above, and the prior discussion is incorporated by reference. However, as illustrated, the attachment plates 78 differ in that in one attachment plate the spring arm 86 faces the first body end 24 so that the implement 32 pivots open from the first body end 24, and in the other attachment plate the spring arm 86 faces the second body end 26 so that the implement 32 pivots open from the second body end 26. This construction may be extended as needed, so that additional implements can be added to either end of the knife. Because the gate attachment 44 and the attachment arm 48 need only be wide enough to support the gate 60, it may be the case that only some of the attachment plates include the gate attachment 44 and the attachment arm 48.

Figure 9:
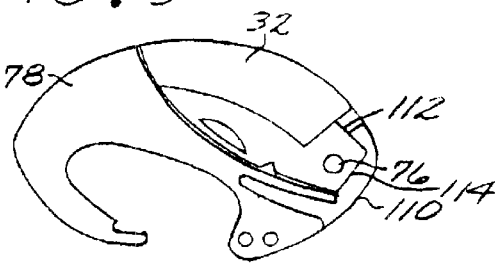
FIG. 9 is an elevational side view of a locking knife according to the invention.
Figure 10:
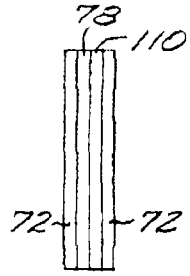
FIG. 10 is an schematic view of the locking knife of FIG. 9 showing its layered construction.

FIGS. 9–10 illustrate an embodiment of the present knife wherein the implement is lockable in the extended position with a side lock mechanism and unlockable. A side-lock plate 110 lies laterally adjacent to the attachment plate 78. A locking finger 112 extends laterally from the side of the side-lock plate 110 to engage a periphery 114 of the implement base when the implement 32 is pivoted to the open position. The locking finger 112 is depressed to move the locking finger 112 away from the implement base and thereby unlock the implement 32 from the extended position. The implement 32 may then be pivoted to the closed position shown in FIG. 9. See for example U.S. Pat. No. 5,755,035 for further details on the operation of side-lock mechanisms. The attachment plate 78 and its spring arm function as described previously, and that description is incorporated here.

Figure 11:
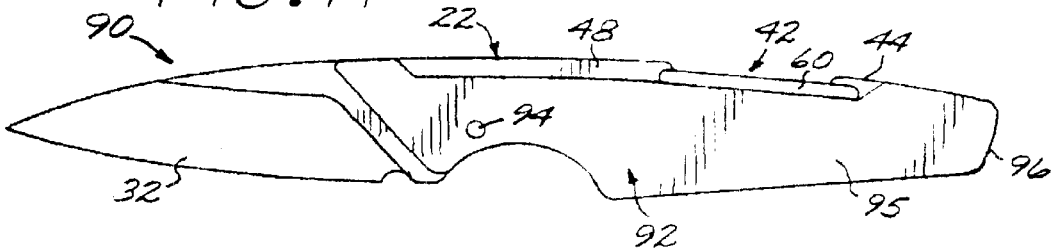
Figure 12:
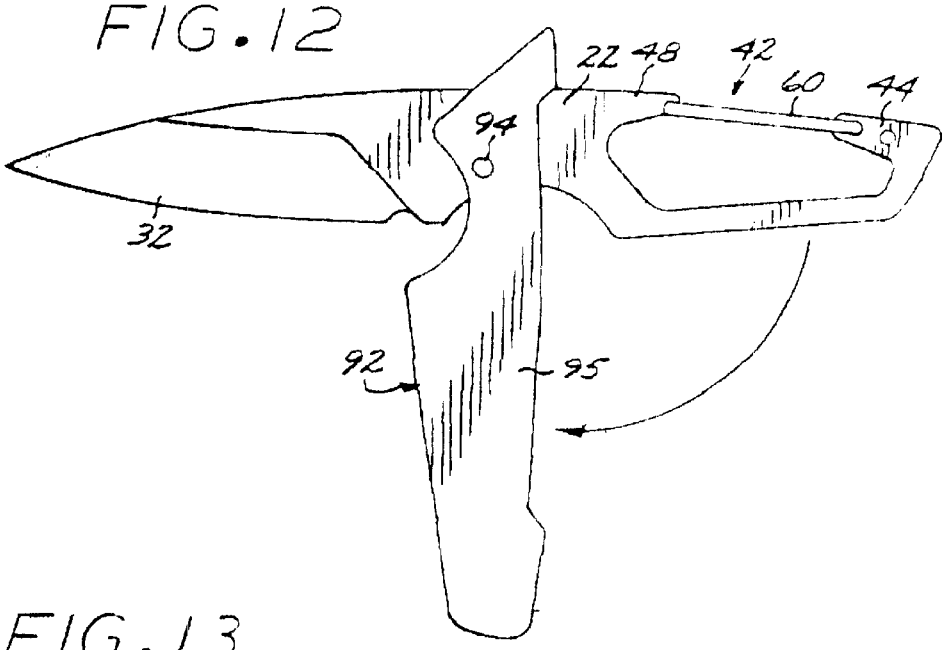
Figure 13:
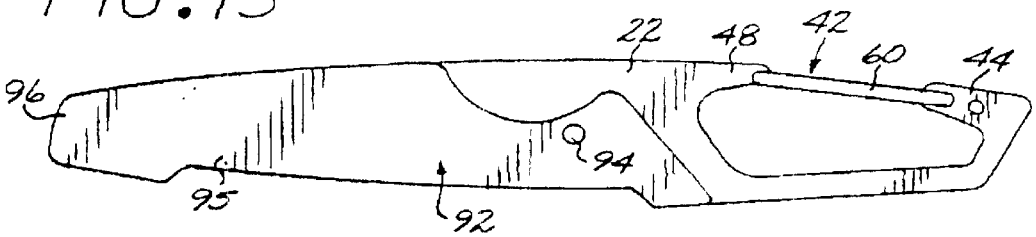

The preceding embodiments have illustrated folding knives wherein the implement pivots between the extended position and the closed position within the knife body. FIGS. 11–13 depict a fixed-implement knife 90 wherein the implement 32 is rigidly joined to the knife body 22. An attachment structure 42 as described previously is present.

Additionally, the knife 90 is provided with an integral sheath 92 that is pivotably attached to the knife body 22 through a sheath pivot 94. The sheath 92 has opposing sides (one of which is visible in the elevational views of FIGS. 11–13 as the sheath side 95) spaced sufficiently far apart that the knife body 22 fits between the sides 95 of the sheath. The sheath has a sheath butt end 96 that join the two sides 95. Together, the sheath butt end 96 and the sheath pivot 94 join the sides 95 to form the integral sheath 92. In the view of FIG. 11, the sheath 92 is pivoted away from the implement 32 to overlie the knife body 22. In the view of FIG. 12, the sheath 92 is pivoted about 90 degrees on the sheath pivot 94 to an intermediate location. In the view of FIG. 13, the sheath 92 is further pivoted to overlie the implement 32 so that the implement 32 (such as a knife blade) is protected from damage and the user of the knife is protected from being cut. When the sheath 92 overlies the knife body 22 as in FIG. 11, the attachment structure 42 is covered and not usable. When the sheath 92 is pivoted to overlie the implement 32 as in FIG. 13, the attachment structure 42 is exposed and accessible for use to attach the knife 20 to other structure, and the implement 32 is covered and protected.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A knife, comprising:

a knife body having a first body end, a second body end, a top, and a bottom;

at least one implement extending from the knife body at the first body end and lying in an implement plane;

an implement-support plate to which an implement base of the implement is pivotably attached at the first body end of the knife body;

an attachment structure comprising a gate attachment integral with the knife body at a first location, wherein the first location is intermediate between the first body end and the second body end, an attachment arm integral with the knife body at a second location, wherein the second location is the second end of the knife, the attachment arm having an attachment-arm end separated from the gate attachment, at least one of the gate attachment and the attachment-arm end being positioned laterally from the knife body so that there is an attachment separation therebetween, an attachment plate from which the gate attachment and the attachment arm extend, and a gate having a first gate end and a second gate end, wherein the first gate end is pivotably joined to the gate attachment, wherein the gate is pivotable in the implement plane between a closed position wherein the second gate end lies adjacent to the attachment-arm end and an open position wherein the second gate end is separated from the attachment-arm end to form an opening between the gate attachment and the attachment-arm end, and wherein the gate is biased toward the closed position; and a spring arm extending from the attachment plate and bearing against the implement base.

2. The knife of claim 1, wherein at least one of the gate attachment and the attachment arm is integral with the knife body along the knife body top.

3. The knife of claim 1, wherein the gate comprises a folded length of wire.

4. The knife of claim 1, wherein the second gate end contacts the attachment-arm end when the gate is in the closed position.

5. The knife of claim 1, wherein the implement is pivotably joined to the first body end.

6. The knife of claim 1, wherein the implement is fixedly joined to the first body end.

7. The knife of claim 1, wherein the knife further comprises an integral sheath pivotably attached to the knife body.

8. The knife of claim 1, wherein the implement base has a cam surface thereon that is contacted by the spring arm.

9. A knife, comprising:

a knife body having a first body end, a second body end, a top, and a bottom;

at least one implement extending from the knife body at the first body end and lying in an implement plane; and an attachment structure comprising a gate attachment integral with the knife body at a first location, wherein the first location is intermediate between the first body end and the second body end, and an attachment arm integral with the knife body at a second location, wherein the second location is the second end of the knife, the attachment arm having an attachment-arm end separated from the gate attachment, at least one of the gate attachment and the attachment-arm end being positioned laterally from the knife body so that there is an attachment separation therebetween;

two spaced-apart and parallel implement-support plates to which an implement base of the implement is pivotably attached at the first end of the knife body to pivot in a plane parallel to the implement-support plates;

an attachment plate lying between the two implement-support plates and in the same plane as the implement, the attachment plate having a spring arm extending therefrom and bearing against the implement base, and the gate attachment and the attachment arm extending from the attachment plate; and a gate having a first gate end and a second gate end, wherein the first gate end is pivotably joined to the gate attachment, wherein the gate is pivotable in the implement plane between a closed position wherein the second gate end lies adjacent to the attachment-arm end and an open position wherein the second gate end is separated from the attachment-arm end to form an opening between the gate attachment and the attachment-arm end, and wherein the gate is biased toward the closed position.

10. The knife of claim 1, wherein the knife has two implements and a respective attachment plate for each of the implements.

11. A knife, comprising:

a knife body having a first body end, a second body end, a top, and a bottom, the knife body comprising two spaced-apart and parallel implement-support plates, and an attachment plate lying parallel to and between the two implement-support plates, the attachment plate including a spring arm extending from the attachment plate;

an implement lying between and pivotably attached to the implement-support plates at the first body end to pivot in an implement plane parallel to the two implement-support plates, the implement lying in the same plane as the attachment plate, the implement having an implement base that is contacted by the spring arm; and an attachment structure comprising a gate attachment integral with and extending from the attachment plate in the implement plane at a location between the first body end and the second body end, an attachment arm integral with and extending from the attachment plate at the second body end, the attachment arm having an attachment-arm end separated from the gate attachment so that there is an attachment separation therebetween, and a gate having a first gate end and a second gate end, wherein the first gate end is pivotably joined to the gate attachment so that the gate is pivotable in the implement plane between a closed position wherein the second gate end lies adjacent to the attachment-arm end and an open position wherein the second gate end is separated from the attachment-arm end to form an opening between the gate attachment and the attachment-arm end, and wherein the gate is biased toward the closed position.

12. The knife of claim 11, wherein the implement base has a cam surface thereon that is contacted by the spring arm.

13. The knife of claim 11, wherein the second gate end is closer to the knife body top when the gate is in the open position than when the gate is in the closed position.

14. The knife of claim 11, wherein the second gate end contacts the attachment-arm end when the gate is in the closed position.

15. A knife, comprising:

a knife body having a first body end, a second body end, a top, and a bottom, wherein the knife body further includes two spaced-apart-and-parallel implement-support plates, and an attachment plate lying between the two implement-support plates;

at least one implement pivotably attached to the implement-support plates of the knife body at the first body end and pivoting in an implement plane; and an attachment structure integral with the knife body and comprising a fixed attachment extending laterally from the attachment plate at the top of the knife body in the implement plane, and a gate pivotably having a first gate end pivotably attached to a first portion of the fixed attachment so that the gate is pivotable in the implement plane between a closed position wherein a second gate end lies adjacent to a second portion of the fixed attachment, and an open position wherein the second gate end does not lie adjacent to the second portion of the fixed attachment.

* * * * *